US012565995B2

(12) United States Patent
Lochschmied et al.

(10) Patent No.: US 12,565,995 B2
(45) Date of Patent: Mar. 3, 2026

(54) CLOSED-LOOP CONTROL OF A COMBUSTION APPARATUS

(71) Applicant: Siemens Aktiengesellschaft, Munich (DE)

(72) Inventors: Rainer Lochschmied, Rheinstetten-Forchheim (DE); Bernd Schmiederer, Karlsruhe (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 902 days.

(21) Appl. No.: 17/864,846

(22) Filed: Jul. 14, 2022

(65) Prior Publication Data

US 2023/0017088 A1 Jan. 19, 2023

(30) Foreign Application Priority Data

Jul. 16, 2021 (EP) ..... 21186036
Feb. 3, 2022 (EP) ..... 22154894

(51) Int. Cl.
*F23N 3/00* (2006.01)
*F23N 5/12* (2006.01)
*F23N 5/26* (2006.01)

(52) U.S. Cl.
CPC ..... *F23N 3/002* (2013.01); *F23N 5/123* (2013.01); *F23N 5/265* (2013.01);
(Continued)

(58) Field of Classification Search
CPC ..... F23N 3/002; F23N 5/123; F23N 5/265; F23N 2223/04; F23N 2223/48; F23N 2227/20; F23N 2229/12; F23N 2231/10
(Continued)

(56) References Cited

U.S. PATENT DOCUMENTS 5,924,859 A * 7/1999 Nolte ..... F23N 5/123 431/18
9,651,255 B2 5/2017 Lochschmied ..... F23N 5/12
(Continued)

FOREIGN PATENT DOCUMENTS

DE 19618573 6/1997
EP 2 466 204 11/2013
(Continued)

*Primary Examiner* — Steven B Mcallister
*Assistant Examiner* — Benjamin W Johnson
(74) *Attorney, Agent, or Firm* — Slayden Grubert Beard PLLC

(57) ABSTRACT

Various embodiments include a combustion apparatus comprising: a control facility for open- and/or closed-loop control of the apparatus; a combustion chamber; an actuator adjusting an air supply; and a combustion sensor in a region of a flame of the chamber. The control facility stores a list of support points. A first air supply value is assigned to each support point. A drift test value and an index for ascertainment of a test result are assigned to each support point. The controller: generates a specified air supply; selects a support point as a function of the air supply; and decides on a test result using the index for the support point. To ascertain a test result: receives a signal from the combustion sensor; determines a new test result; ascertains a changed drift test value for the selected support point; and stores the changed drift test value as the drift test value.

19 Claims, 3 Drawing Sheets

(52) U.S. Cl.
CPC ..... *F23N 2223/04* (2020.01); *F23N 2223/48* (2020.01); *F23N 2227/20* (2020.01); *F23N 2229/12* (2020.01); *F23N 2231/10* (2020.01)

(58) Field of Classification Search
USPC ..... 431/12
See application file for complete search history.

(56) References Cited

U.S. PATENT DOCUMENTS

| | | | | |
|---|---|---|---|---|
| 10,054,309 | B2 | 8/2018 | Born | F23C 99/00 |
| 2011/0018544 | A1* | 1/2011 | Bertelli | F23N 5/242<br>324/459 |
| 2012/0156628 | A1* | 6/2012 | Lochschmied | F23N 5/12<br>431/78 |
| 2016/0209026 | A1* | 7/2016 | Born | F23N 5/123 |
| 2018/0274782 | A1* | 9/2018 | Schmiederer | F23N 5/265 |

FOREIGN PATENT DOCUMENTS

| | | |
|---|---|---|
| EP | 3 045 816 | 7/2016 |
| EP | 3 290 800 | 3/2018 |

* cited by examiner

CLOSED-LOOP CONTROL OF A COMBUSTION APPARATUS

CROSS-REFERENCE TO RELATED APPLICATIONS

This application claims priority to EP Application No. 22154894.4 filed Feb. 3, 2022 and EP Application No. 21186036.6 filed Jul. 16, 2021, the contents of which are hereby incorporated by reference in their entirety.

TECHNICAL FIELD

The present disclosure relates to combustion apparatuses. Various embodiments of the teachings herein include regulating curves, as are used in conjunction with combustion sensors in combustion apparatuses, for example in gas burners with combustion sensors, for example, ionization electrodes. In particular, various embodiments of the present disclosure include systems and/or methods for correction of such regulating curves by taking into account the ageing and/or drift of a sensor signal.

BACKGROUND

In combustion apparatuses the air number A may be ascertained during combustion on the basis of a combustion sensor. In particular, the air number A may be ascertained on the basis of an ionization current through an ionization electrode. Firstly, an alternating voltage is applied to the combustion sensor, in particular to the ionization electrode, in this case. Owing to the rectifier effect of a flame, an ionization current flows as a direct current in only one direction.

In regulating curves for combustion sensors, the ionization current detected at the combustion sensor is plotted over the rotational speed of the fan of a combustion apparatus. The ionization current is typically measured in microamperes. The rotational speed of the fan of a combustion apparatus is typically measured in revolutions per minute. The rotational speed of the fan of a combustion apparatus is simultaneously a measure of an air supply and a power of the combustion apparatus, in other words a quantity of heat per unit of time.

A large number of setpoint values is plotted along such a regulating curve. Firstly, such setpoint values can be acquired under laboratory conditions during the course of tests and/or adjustments on a sample device. The acquired values are stored and taken into account in an open-loop and/or closed-loop control, in particular in an electronic open-loop and/or closed-loop control.

Combustion sensors, in particular ionization electrodes, are subject to ageing during operation. This ageing is caused by deposits and/or coatings during operation of a combustion apparatus. For example, an oxide layer can form on the surface of an ionization electrode, the thickness of which layer changes during the course of the operating hours. A signal of the at least one combustion sensor drifts as a consequence of the ageing of the at least one combustion sensor. For example, with ionization electrodes the ionization current drifts as a consequence of the ageing. Therefore, a regulating curve acquired under laboratory conditions sometimes, at the latest after one thousand to three thousand operating hours, requires a correction.

A closed-loop control facility with correction of the regulating curve of an ionization electrode is disclosed in European patent EP2466204B1. In this case, the regulating curve is corrected with the aid of a test run in three steps, and this is called a drift test below. Firstly, the closed-loop control facility carries out a regulated operation on a defined air supply or rotational speed or power. The closed-loop control facility then performs open-loop/closed-loop control of the actuators of the combustion apparatus in response to a changed supply ratio. In particular, the rotational speed of the fan of a combustion apparatus is changed. The closed-loop control facility sets an air supply of the combustion apparatus by way of the open-loop control of the actuators.

The changed supply ratio is above the stochiometric value of the air number λ of 1. The air number λ may be reduced by 0.1 or by 0.06 to values greater than or equal to 1.05. A setpoint value is recalculated from the detected ionization current and from stored data in a third step.

A further European patent EP3045816B1, Device for the control of a burner assembly, discloses and claims a control which calculates a shifted ionization current for a different rotational speed on the basis of a current ionization current and on the basis of a previously acquired ionization current. The shifted ionization current can then be filtered to the historic ionization current of the second rotational speed. Correction of the regulating curve presupposes, however, that the heat generated for the duration of the drift test can also be dissipated to consumers such as heating or wash water. Otherwise, the quantity of heat generated during the drift test is greater than the removed quantity of heat. As a result, the temperature in the system increases and the temperature regulator of the assembly switches off the combustion apparatus. The drift test at a particular air supply cannot be concluded in this case.

This problem is intensified by the fact that some time is required during a drift test to obtain stable values. In combustion apparatuses without a sensor in the air supply duct some time elapses, moreover, during which the regulation sets or adjusts the air supply on the basis of the fan rotational speed. Compounding this is the fact that the duration of a drift test may not generally be shortened as desired.

SUMMARY

The teachings of the present disclosure include various systems and/or methods for an improved correction of the regulating curve of a combustion sensor, which at least partially overcomes said drawbacks. For example, some embodiments include a combustion apparatus (1) comprising a facility (18) for open-loop and/or closed-loop control of the combustion apparatus (1), the combustion apparatus (1) comprising at least one combustion chamber (2), at least one actuator (4), which acts on an air supply for the at least one combustion chamber (2), and at least one combustion sensor (9), which is arranged such that during operation of the combustion apparatus (1) it is located in the region of a flame of the at least one combustion chamber (2), wherein the open-loop and/or closed-loop control facility (18) comprises a memory with at least one list of support points, wherein a first air supply value of the combustion apparatus (1) is assigned to each support point from the at least one list of support points and wherein a drift test value and an index for ascertainment of a test result are assigned to each support point from the at least one list of support points, wherein the open-loop and/or closed-loop control facility (18) is configured to: generate a specified air supply for the at least one combustion chamber (2) of the combustion apparatus (1) on the basis of the at least one actuator (4); after generating the specified air supply, select a support point from the at least one list of support points as a function of the specified air supply and on the basis of the first air supply values; decide on the ascertainment of a test result on the basis of the index for the selected support point; in case of a decision in favor of the ascertainment of a test result: receive one or more signal(s) on the basis of the at least one combustion sensor (9); determine a new test result from the one signal or from the plurality of signals of the at least one combustion sensor (9); ascertain a changed drift test value for the selected support point as a function of the new test result; and store the changed drift test value in the memory of the open-loop and/or closed-loop control facility (18) as the drift test value assigned to the selected support point.

In some embodiments, a power of the combustion apparatus (1) stored in the memory is assigned to each support point from the at least one list of support points, wherein the open-loop and/or closed-loop control facility (18) is configured to: ascertain a power of the combustion apparatus (1) from the specified air supply; and after generating the specified air supply, select the support point from the at least one list of support points as a function of the ascertained power.

In some embodiments, after generating the specified air supply, the open-loop and/or closed-loop control facility (18) is configured to: form in each case differences between the specified air supply and the first air supply values; select the difference whose value is the lowest; and select from the at least one list of support points the support point, which pertains to the difference with the lowest value.

In some embodiments, a number of operating hours of the combustion apparatus (1) until the next start of an ascertainment of a test result is assigned to each support point from the at least one list of support points as an index for the ascertainment of the test result and is stored in the memory, wherein the open-loop and/or closed-loop control facility (18) is configured to: ascertain a current number of operating hours; compare the number of operating hours until the next start of the ascertainment of the test result for the selected support point with the current number of operating hours; if the current number of operating hours is greater than or equal to the number of operating hours until the next start of the ascertainment of the test result for the selected support point: receive the one signal or the plurality of signals on the basis of the at least one combustion sensor (9); and determine a new test result from the one signal or from the plurality of signals of the at least one combustion sensor (9).

In some embodiments, the open-loop and/or closed-loop control facility (18) is configured to: ascertain the changed drift test value for the selected support point as a function of the new test result and as a function of the drift test value assigned to the selected support point.

In some embodiments, the open-loop and/or closed-loop control facility (18) is configured to: ascertain a first percentage as a function of the difference with the lowest value; and ascertain the changed drift test value for the selected support point by weighting the new test result according to the first percentage and by weighting the drift test value assigned to the selected support point according to a second percentage.

In some embodiments, the open-loop and/or closed-loop control facility (18) is configured to: regulate the combustion apparatus (1) on the basis of the changed drift test value stored in the memory of the open-loop and/or closed-loop control facility (18).

In some embodiments, after generating the specified air supply, the open-loop and/or closed-loop control facility (18) is configured to: form in each case differences between the specified air supply and the first air supply values; select from the formed differences the negative difference whose value is the lowest; select from the formed differences the positive difference whose value is the lowest; select from the at least one list of support points the support point, which pertains to the negative difference with the lowest value, as the first support point; and select from the at least one list of support points a second support point, which pertains to the positive difference with the lowest value.

In some embodiments, the open-loop and/or closed-loop control facility (18) is configured to: ascertain a first, changed drift test value for the first support point as a function of the new test result; ascertain a second, changed drift test value for the second, selected support point as a function of the new test result; store the first, changed drift test value in the memory of the open-loop and/or closed-loop control facility (18) as the drift test value assigned to the first support point; and store the second, changed drift test value in the memory of the open-loop and/or closed-loop control facility (18) as the drift test value assigned to the second support point.

In some embodiments, a number of operating hours of the combustion apparatus (1) until the next start of an ascertainment of a test result is assigned for each support point from the at least one list of support points as an index for the ascertainment of the test result and is stored in the memory, wherein the open-loop and/or closed-loop control facility (18) is configured to: ascertain a current number of operating hours; and compare the number of operating hours until the next start of the ascertainment of the test result for the first support point with the current number of operating hours.

In some embodiments, the open-loop and/or closed-loop control facility (18) is configured to, if the current number of operating hours is greater than or equal to the number of operating hours until the next start of the ascertainment of the test result for the first support point, ascertain a third percentage as a function of the negative difference with the lowest value; translate the new test result to the first support point; and ascertain the first, changed drift test value for the first support point by weighting the test result translated to the first support point according to the third percentage and by weighting the drift test value assigned to the first support point according to a fourth percentage.

In some embodiments, a number of operating hours of the combustion apparatus (1) until the next start of an ascertainment of a test result is assigned for each support point from the at least one list of support points as an index for the ascertainment of the test result and is stored in the memory, wherein the open-loop and/or closed-loop control facility (18) is configured to ascertain a current number of operating hours and compare the number of operating hours until the next start of the ascertainment of the test result for the second support point with the current number of operating hours.

In some embodiments, the open-loop and/or closed-loop control facility (18) is configured to, if the current number of operating hours is greater than or equal to the number of operating hours until the next start of the ascertainment of the test result for the second support point, ascertain a fifth percentage as a function of positive difference with the lowest value; translate the new test result to the second support point; and ascertain the second, changed drift test value for the second support point by weighting the test result translated to the second support point according to the fifth percentage and by weighting the drift test value assigned to the second support point according to a sixth percentage.

In some embodiments, the open-loop and/or closed-loop control facility (18) is configured to regulate the combustion apparatus (1) on the basis of the first, changed drift test value stored in the memory of the open-loop and/or closed-loop control facility (18) and on the basis of the second, changed drift test value stored in the memory of the open-loop and/or closed-loop control facility (18).

In some embodiments, the open-loop and/or closed-loop control facility (18) is communicatively connected to the at least one actuator (4); and wherein the open-loop and/or closed-loop control facility (18) is communicatively connected to the at least one combustion sensor (9).

BRIEF DESCRIPTION OF THE DRAWINGS

Various features will be obvious to a person skilled in the art from the following detailed description of the disclosed, non-limiting embodiments. The drawings, which are appended to the detailed description, can be briefly described as follows.

DETAILED DESCRIPTION

Figure 1:
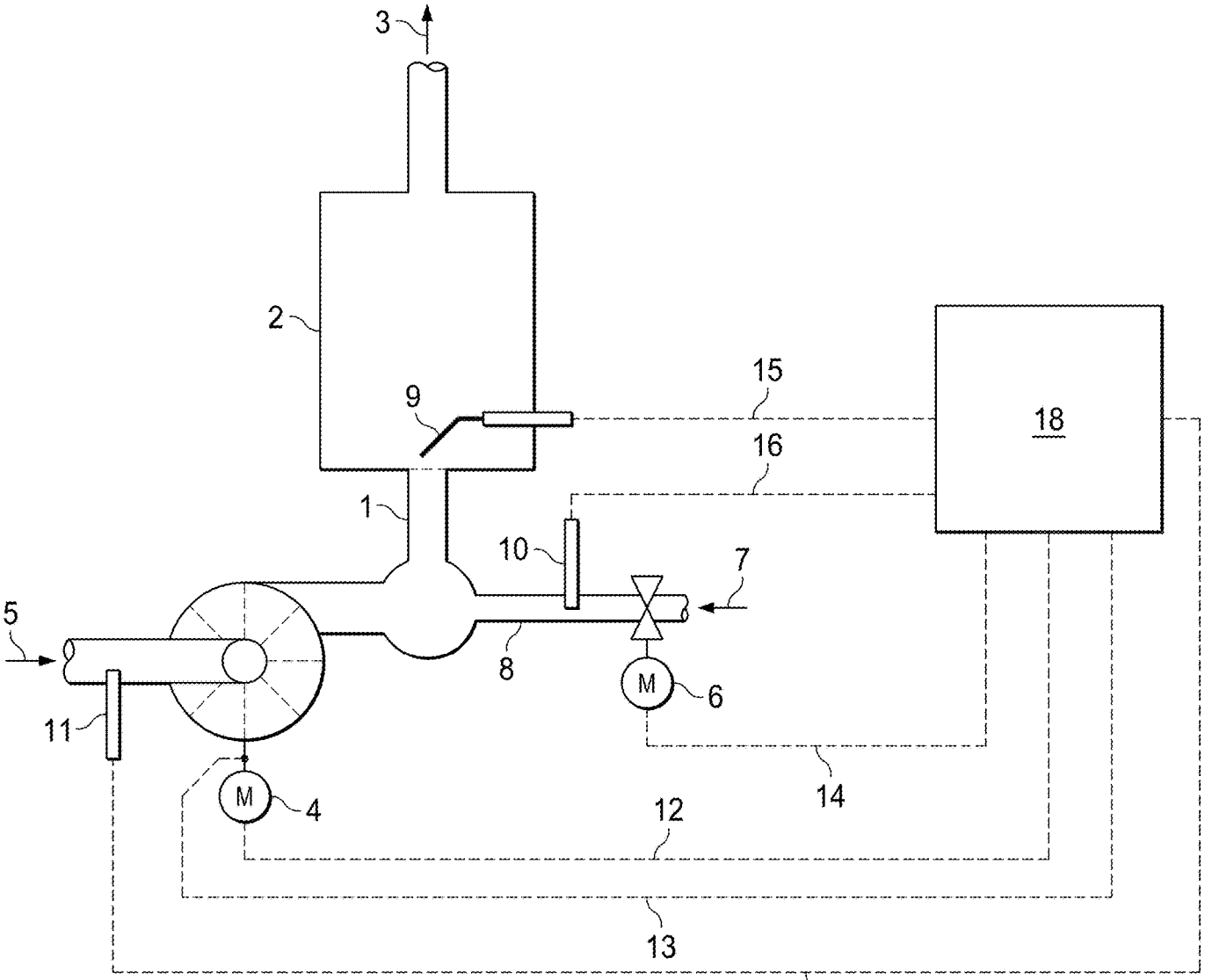
FIG. 1 shows a combustion apparatus with a combustion sensor in the form of an ionization electrode incorporating teachings of the present disclosure.

The present disclosure provides teaching relevant to drift tests on a combustion sensor of a combustion apparatus. The combustion sensor can comprise, for example, an ionization electrode. Combustion sensors, in particular ionization electrodes, are subject to ageing during operation. That ageing makes it necessary to carry out drift tests. On the basis of the drift test, it is established how far setpoint values and/or test results of a combustion sensor, in particular an ionization electrode, have shifted as a consequence of ageing. Until now it has been necessary to approach one of a plurality of support points in order to carry out the drift test. For this, the air supply or the fan rotational speed or the power is set or adjusted such that it matches the support point at which the drift test is carried out. The teachings of the present disclosure allow drift tests outside of the defined support points.

Firstly, on the basis of an index it is determined whether a drift test is pending at that support point. The index can be, for example, a number of operating hours after which a drift test is carried out and/or repeated. If this is the case, the test conditions are obtained, for example by way of a suitable interpolation between the support points, for the current air supply or fan rotational speed or power. Starting from this current (and thereby with any desired or almost any desired) air supply or fan rotational speed or power, a test value is acquired. It is also possible to acquire a plurality of test values of the signal of the combustion sensor, in particular of the ionization electrode. The plurality of test values can then be, for example, averaged and/or checked for plausibility.

The test result obtained in this way is now applied or translated to an adjacent support point of the calibration curve and/or setpoint value curve and/or reference value curve.

Finally, a new filtered drift test value is ascertained for the adjacent support point as a function of the test result obtained from the further drift test. For this, the translated test result is filtered at the adjacent support point to the previous drift test value. This new filtered drift test value is then stored in the memory of an open-loop and/or closed-loop control facility. In particular, the new filtered drift test value can be stored in the memory of the open-loop and/or closed-loop control facility as part of a calibration curve and/or setpoint value curve and/or reference value curve.

In some embodiments, the distance of the current air supply or fan rotational speed or power from the adjacent support point is taken into account when ascertaining the new filtered drift test value. The weight with which the translated test result is applied to the adjacent support point, is therefore a function of that distance. Preferably, the weighting decreases, in particular monotonously, as the distance increases. This weighted procedure prevents excessively large changes in values of the calibration curve and/or setpoint value curve and/or reference value curve. The probability of an incorrect or implausible, stored value decreases.

A current air supply or fan rotational speed or power can have more than one adjacent support point. In particular, two adjacent support points can be present, wherein the current air supply or fan rotational speed or power is located between the two adjacent support points. In some embodiments, an individual check is then made for each adjacent support point on the basis of a respective index as to whether a drift test is pending. In particular, it is possible to check, for each adjacent support point on the basis of a respective number of operating hours, whether a drift test is pending.

If a drift test is pending for an adjacent support point or for both adjacent support points, the respective filtered drift test values are corrected as a function of the newly ascertained test result. In some embodiments, a weighting can be applied to each correction. In some embodiments, the weightings are in each case a function of the respective distance of the current air supply or fan rotational speed or power from the support point or the support points. In some embodiments, the weightings decrease as the distance of the current air supply or fan rotational speed or power from the support point increases. In particular, the weightings can decrease monotonously and/or decrease linearly and monotonously.

The calibration curve and/or setpoint value curve and/or reference value curve is kept as current as possible by application of the newly ascertained test result to more than one adjacent support point.

Furthermore, the newly ascertained test result translated to the adjacent support points can be applied by way of a weighting function to more than two support points of the calibration curve and/or setpoint value curve and/or reference value curve. The weighting function may be standardized, for example standardized to one. The integral over the entire value range of a standardized weighting function is finite. In particular, the weighting function standardized over the entire value range can be equal to one.

In some embodiments, the weighting function has its maximum in the case of the current air supply or fan rotational speed or power. It decreases in each direction starting from the current air supply or fan rotational speed or power. In some embodiments, the weighting function decreases monotonously in each direction starting from the current air supply or fan rotational speed or power. In some embodiments, the weighting function decreases monotonously and linearly in each direction starting from the current air supply or fan rotational speed or power. The selection of a suitable weighting function ensures that test results relating to very remote support points are not excessively corrected. The probability of an incorrect or implausible, stored test result or filtered drift test value reduces therewith.

In some embodiments, the newly ascertained and translated test result is applied by applying the weighting function to all those support points of the calibration curve and/or setpoint value curve and/or reference value curve for which a drift test is pending.

FIG. 1 shows a combustion apparatus 1 such as a wall-mounted gas burner and/or an oil burner. During operation a flame of a heat generator burns in the combustion chamber 2 of the combustion apparatus 1. The heat generator exchanges the thermal energy of the hot fuel gases into a different fluid such as water. For example, a hot water heating system is operated and/or drinking water is heated with the warm water. In some embodiments, goods, for example in an industrial process, can be heated with the thermal energy of the hot fuels and/or fuel gases. In some embodiments, the heat generator is part of a system with combined heat and power generation, for example a motor of such a system. In some embodiments, the heat generator is a gas turbine. Furthermore, the heat generator can serve to heat water in a system for the extraction of lithium and/or lithium carbonate. The exhaust gases 3 are discharged, for example via a chimney, from the combustion chamber 2.

The air supply 5 for the combustion process is supplied via a (motor-) driven fan 4. An open-loop and/or closed-loop control facility 18 specifies to the fan 4 via the signal line 12 the air supply $V_L$ which it should convey. The fan rotational speed is thereby a measure of the air supply 5.

In some embodiments, the fan rotational speed is reported to the open-loop and/or closed-loop control facility 18 by the fan 4. For example, the open-loop and/or closed-loop control facility 18 ascertains the rotational speed of the fan 4 via the signal line 13.

The open-loop and/or closed-loop control facility 18 preferably comprises a microcontroller. The open-loop and/or closed-loop control facility 18 ideally comprises a microprocessor. The open-loop and/or closed-loop control facility 18 can be a closed-loop facility. Preferably, the closed-loop facility comprises a microcontroller. The closed-loop facility ideally comprises a microprocessor. The closed-loop facility can comprise a proportional and integral regulator. Furthermore, the closed-loop facility can comprise a proportional and integral and derivative regulator. Furthermore, the open-loop and/or closed-loop control facility 18 can comprise a (logic-) gate array programmable in the field. In addition, the open-loop and/or closed-loop control facility 18 can comprise an application-specific integrated circuit.

In some embodiments, the signal line 12 comprises an optical fiber. For ascertainment of the fan rotational speed the signal line 13 can likewise comprise an optical fiber. In some embodiments, the signal lines 12 and 13 are configured as optical fibers. Optical fibers provide advantages in view of galvanic isolation and protection from explosions.

If the air supply 5 is set via an air damper and/or a valve, the damper and/or valve setting can be used as a measure of the air supply 5. Furthermore, a measured value derived from the signal of a pressure sensors and/or mass flow sensor and/or volume flow sensor can be used. The sensor 11 may be arranged in the duct for the air supply 5. In some embodiments, the sensor 11 provides a signal, which is converted using a suitable signal processing unit into a flow measured value.

In some embodiments, the signal of the sensor 11 is reported on the basis of a signal line 17. In particular, a signal can be reported to the open-loop and/or closed-loop control facility 18 on the basis of the signal line 17, which signal is a measure of an air supply 5. The signal line 17 can comprise an optical fiber. Optical fibers provide advantages in view of galvanic isolation and protection against explosions. A suitable signal processing facility for processing of the signal of the sensor 11 may comprise at least one analog-to-digital converter. In some embodiments, the signal processing facility, in particular the analog-to-digital converter(s), is integrated in the open-loop and/or closed-loop control facility 18.

The measured value of a pressure sensor and/or a mass flow sensor in a side duct of the air supply 5 can also be used as a measure of the air supply $V_L$. A combustion apparatus with supply duct and side duct is disclosed, for example, in the European patent EP3301364B1. A combustion apparatus with supply duct and side duct is described, wherein a mass flow sensor protrudes into the supply duct.

A pressure sensor and/or a mass flow sensor in the side duct ascertains a signal, which corresponds to the pressure value and/or the air flow (particle and/or mass flow) in the side duct which is dependent on the air supply $V_L$. In some embodiments, the sensor provides a signal, which is converted on the basis of a suitable signal processing facility into a measured value. In some embodiments, the signals of a plurality of sensors are converted into a shared measured value. A suitable signal processing facility ideally comprises at least one analog-to-digital converter. In some embodiments, the signal processing facility, in particular the analog-to-digital converter(s), is integrated in the open-loop and/or closed-loop control facility 18. In some embodiments, the signal processing facility, in particular the analog-to-digital converter(s), is integrated in the pressure sensor and/or mass flow sensor. The sensor signals are transmitted to the open-loop and/or closed-loop control facility 18 with a specified communications bus protocol via a communications interface.

In some embodiments, the air supply $V_L$ is the value of the current airflow rate. The airflow rate can be measured and/or given in cubic meters of air per hour. The air supply $V_L$ can be measured and/or given in cubic meters of air per hour.

Mass flow sensors allow measurement in the case of large flow speeds, specifically in connection with combustion apparatuses during operation. Typical values of such flow speeds lie in ranges between 0.1 meters per second and 5 meters per second, 10 meters per second, 15 meters per second, 20 meters per second, or even 100 meters per second. Mass flow sensors, which are suitable for the present disclosure, are for example OMRON® D6F-W or SENSOR TECHNICS® WBA type sensors. The usable range of these sensors typically begins at speeds between 0.01 meters per second and 0.1 meters per second and ends at a speed such as, for example 5 meters per second, 10 meters per second, 15 meters per second, 20 meters per second, or even 100 meters per second. In other words, lower limits such as 0.1 meters per second can be combined with upper limits such as 5 meters per second, 10 meters per second, 15 meters per second, 20 meters per second, or even 100 meters per second.

The fuel supply $V_B$ is set and/or adjusted by the open-loop and/or closed-loop control facility 18 with the aid of a fuel actuator and/or a (motor-) settable valve 6. In the embodiment in FIG. 1, the fuel 7 is a fuel gas. A combustion apparatus 1 can then be connected to different fuel gas sources, for example to sources with a high methane content and/or to sources with a high propane content. Similarly, it is provided that the combustion apparatus 1 is connected to a source of a gas or a gas mixture, with the gas or the gas mixture comprising hydrogen. In FIG. 1 the quantity of fuel gas is set by the open-loop and/or closed-loop control facility 18 by way of a (motor-) settable fuel valve 6. The actuation value, for example a pulse width-modulated signal, of the gas valve is a measure of the quantity of fuel gas. It is also a value for the fuel supply $V_B$.

If a gas valve is used as the fuel actuator 6, the position of a valve can thus be used as a measure of the quantity of fuel gas. In some embodiments, a fuel actuator 6 and/or fuel valve is set on the basis of a step motor. In that case the step position of the step motor is a measure of the quantity of fuel gas. The fuel valve can also be integrated in a unit with at least one or more safety shut-off valve(s). A signal line 14 connects the fuel actuator 6 to the open-loop and/or closed-loop control facility 18. In a specific embodiment, the signal line 14 comprises an optical fiber. Optical fibers provide advantages in view of galvanic isolation and protection against explosions.

Furthermore, the fuel valve 6 can be an internal valve operated with closed-loop control via a flow and/or pressure sensor 10, which receives a setpoint value and regulates the actual value of the flow and/or pressure sensor 10 to the setpoint value. The flow and/or pressure sensor 10 can be implemented as a volume flow sensor for example as a turbine flowmeter or as a bellows-type gas flowmeter or as a differential pressure sensor. The flow and/or pressure sensor 10 can also be configured as a mass flow sensor, for example as a thermic mass flow sensor. A signal line 16 connects the flow and/or pressure sensor 10 to the open-loop and/or closed-loop control facility 18. In a specific embodiment, the signal line 16 comprises an optical fiber. Optical fibers provide advantages in view of galvanic isolation and protection against explosions.

In some embodiments, the flow and/or pressure sensor 10 is arranged in the fuel supply duct 8 separately from the fuel valve 6. The flow rate sensor 10 can be implemented as a volume flow sensor, for example as a turbine flowmeter or bellows-type gas flowmeter or as a differential pressure sensor. The flow and/or pressure sensor 10 can also be configured as a mass flow sensor, for example as a thermic mass flow sensor. A signal line 16 connects the flow and/or pressure sensor 10 to the open-loop and/or closed-loop control facility 18. In a specific embodiment, the signal line 16 comprises an optical fiber. Optical fibers provide advantages in view of galvanic isolation and protection against explosions.

That flow and/or pressure sensor 10 generates a signal, which is converted on the basis of a suitable signal processing facility into a flow measured value (measured value of the particle and/or mass flow and/or volume flow). A suitable signal processing facility ideally comprises at least one analog-to-digital converter. In some embodiments, the signal processing facility, in particular the analog-to-digital converter(s), is integrated in the open-loop and/or closed-loop control facility 18. In some embodiments, the signal processing facility, in particular the analog-to-digital converter(s), is integrated in the flow and/or pressure sensor. The sensor signals are transmitted to the open-loop and/or closed-loop control facility 18 via a communications interface with a specified communications bus protocol.

FIG. 1 likewise shows a combustion apparatus 1 with a combustion sensor 9 for detection of an air number A. The combustion sensor 9 can comprise, for example, an ionization electrode. The combustion sensor 9 can also be an ionization electrode. KANTHAL®, for example APM® or A-1®, is often used as the material for an ionization electrode. Electrodes made from Nikrothal® are also considered by a person skilled in the art. The combustion sensor 9 may be arranged in the combustion chamber 2.

A signal line 15 connects the combustion sensor 9 to the open-loop and/or closed-loop control facility 18. In some embodiments, the signal line 15 comprises an optical fiber. Optical fibers may provide advantages in view of galvanic isolation and protection against explosions.

Typically, the combustion sensor 9 is connected via an impedance to a voltage source. The impedance to the connection to the voltage source can comprise an electrical resistance, in particular an electrical, ohmic resistance.

Figure 2:
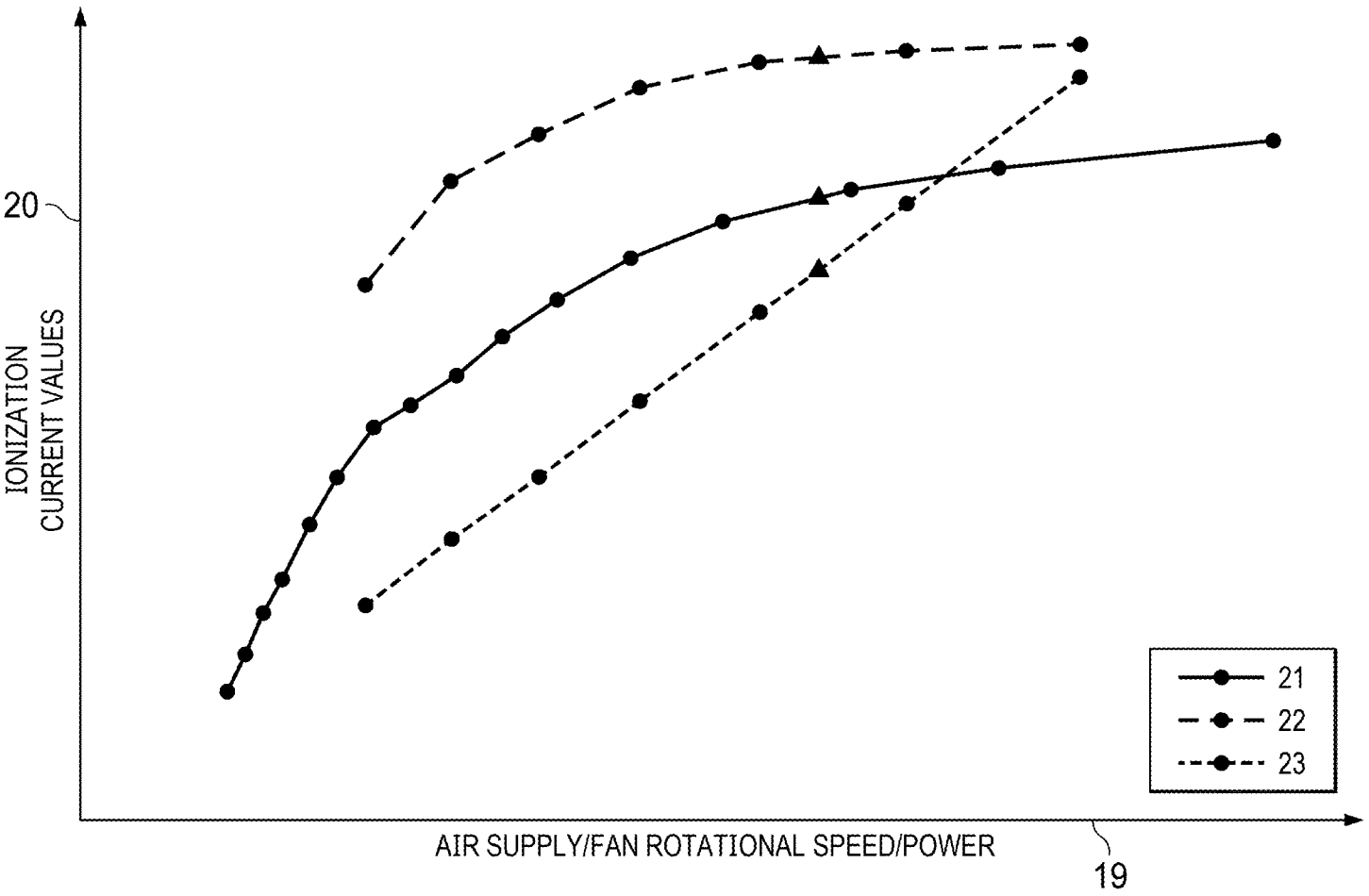
FIG. 2 shows two characteristic curves of the ionization current over an air supply or fan rotational speed or power of the combustion apparatus and in addition a characteristic curve of the first, upper air supply or fan rotational speed or power relating to the second, lower air supply or fan rotational speed or power for the drift test implementation incorporating teachings of the present disclosure.
Figure 3:
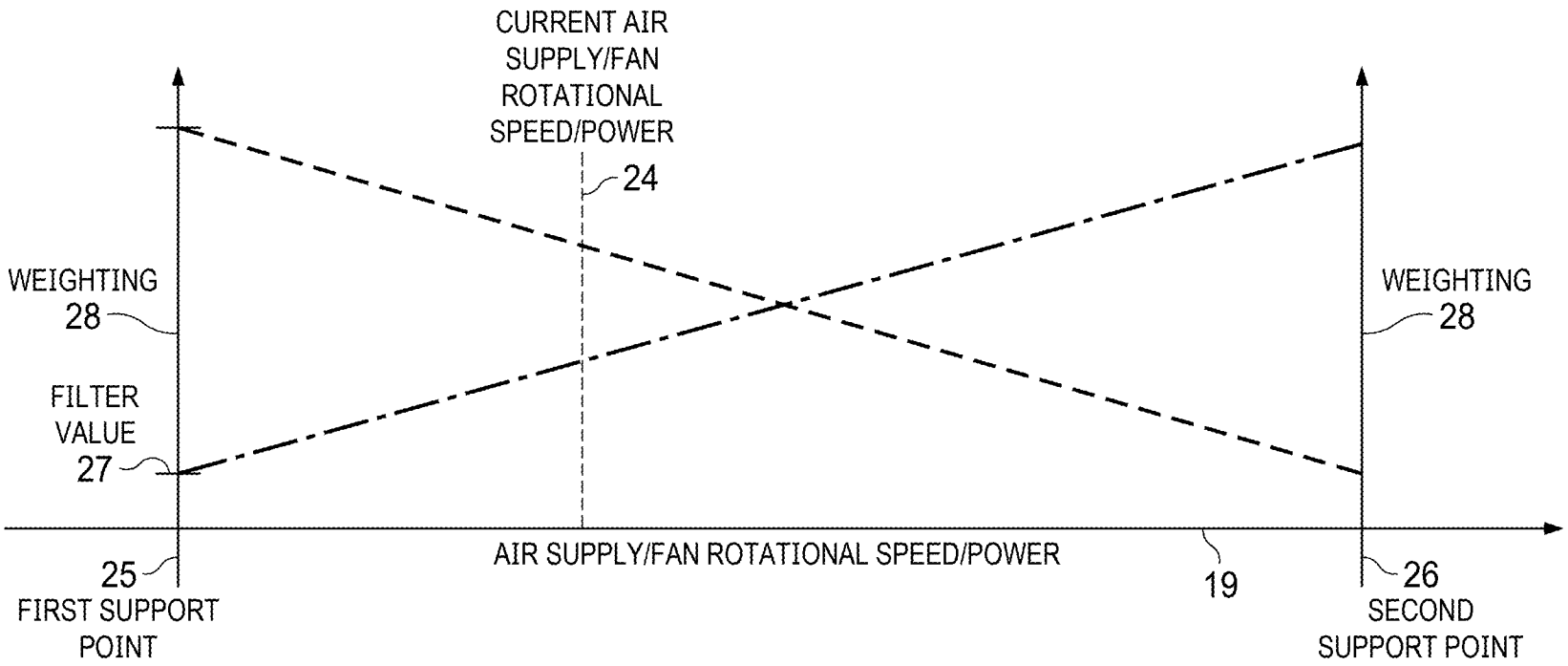
FIG. 3 illustrates the determination of the weighting factor for the translated new test result, in particular of a new ionization current, at two adjacent support points incorporating teachings of the present disclosure.

The curve 21 in FIG. 2 illustrates by way of example setpoint values of the signals of a combustion sensor 9. The curve 22 illustrates by way of example reference values for the drift test from the signals of a combustion sensor 9 over an air supply or fan rotational speed or power 19. In particular, the curves 21 and 22 can illustrate ionization current values 20 over air supply or fan rotational speed or power 19. The air supply or fan rotational speed or power 19 along the abscissa may be an air supply or fan rotational speed or power 19 of a combustion apparatus 1.

The curve 21 in FIG. 2 shows setpoint values of the signals of a combustion sensor 9 in the as-delivered state of the at least one combustion sensor 9. In some embodiments, the curve 21 shows ionization current setpoint values in the as-delivered state of an ionization electrode for normal regulated operation. The curve 21 is supported by a plurality of values of the air supply or fan rotational speed or power 19. For those values of the air supply or fan rotational speed or power 19 there exist in each case setpoint values of the signal of the at least one combustion sensor 9 in the as-delivered state. In particular, setpoint values of the ionization current of an ionization electrode in the as-delivered state can exist for those values: air supply or fan rotational speed or power 19.

FIG. 2 shows by way of example for curve 21 sixteen such supporting values of the air supply or fan rotational speed or power 19. A setpoint value of a signal of a combustion sensor 9 in the as-delivered state pertains to each supporting value of the air supply or fan rotational speed or power 19. In particular, a setpoint value of an ionization current of an ionization electrode in the as-delivered state can pertain to each supporting value of the air supply or fan rotational speed or power 19. The supporting values and the ionization current setpoint values associated in each case form the support points of the regulating curve for normal regulated operation in the as-delivered state of the open-loop and/or closed-loop control facility 18. The supporting values are such supporting values of the air supply or fan rotational speed or power 19 in this case.

The curve 22 in FIG. 2 shows reference values for a drift test of the at least one combustion sensor 9 on changing. In particular, curve 22 shows reference ionization currents for a drift test of an ionization electrode on changing. In the present case a combustion sensor 9 or an ionization electrode can change, for example due to ageing. In particular, ageing can be accompanied by the formation of deposits on the combustion sensor 9 or on the ionization electrode.

The curve 22 is supported by a plurality of values of the air supply or fan rotational speed or power 19. For those values of the air supply or fan rotational speed or power 19 there exist in each case reference values of the signal of the at least one combustion sensor 9. In particular, reference values of the ionization current of an ionization electrode exist for those values of the air supply or the fan rotational speed or the power 19.

FIG. 2 shows by way of example for curve 22 seven such supporting values of the air supply or fan rotational speed or power 19. A reference value of a signal of a combustion sensor 9 pertains to each supporting value of the air supply or fan rotational speed or power 19. In particular, a reference value of an ionization current for a drift test of an ionization electrode can pertain to each supporting value of the air supply or fan rotational speed or power 19. The supporting values of the air supply or fan rotational speed or power 19 and the reference ionization currents associated in each case form the support points of the reference curve for drift tests of the ionization electrode.

Supporting values of the air supply or fan rotational speed or power 19 for curve 22 are generally not identical to supporting values: air supply or fan rotational speed or power 19 for curve 21. The respective supporting values of the curves 21 and 22 can differ in terms of their number. Furthermore, the respective supporting values of the curves 21 and 22 can differ in terms of their position. This means that the respective supporting values of the curves 21 and 22 pertain to non-identical values of the air supply or fan rotational speed or power 19.

The curve 23 in FIG. 2 represents the change in the air number A during a drift test implemented by the rotational speed and/or the fuel valve. In the present case, it represents a first, upper air supply or fan rotational speed or power over a second, lower air supply or fan rotational speed or power for a drift test of the at least one combustion sensor 9. The appertaining ordinate axis is the second ordinate axis. It comprises the same value range as the abscissa axis. A supporting value of the air supply or fan rotational speed or power 19 of curve 22 pertains to each supporting value of the air supply or fan rotational speed or power 19 of curve 23. The supporting values of the air supply or fan rotational speed or power 19 of the curve 23 correspond to the second, lower air supplies or fan rotational speeds or powers for drift tests. Together with the respectively appertaining first, upper air supplies or fan rotational speeds or powers for a drift test they form the support points for drift tests. A drift test value, that is a value ascertained from the associated test results by filtering, and an index for an ascertainment of a test result are assigned to each one of these drift test support points. In some embodiments, a reference value is assigned to each drift test support point.

The value on curve 21 corresponding to a supporting value of the air supply or fan rotational speed or power 19 of curve 23 can be a supporting value of the air supply or fan rotational speed or power 19 of curve 21. The value on curve 21 corresponding to a supporting value of the air supply or fan rotational speed or power 19 of curve 23 does not have to be a supporting value of the air supply or fan rotational speed or power 19 of curve 21 though. If no supporting value of curve 21 exists for a supporting value of curve 22 and 23, then it is possible to interpolate between the values of curve 21. For example, it is possible to linearly interpolate between adjacent points. The interpolated value is then used in order to ascertain an associated setpoint value for the normal regulated operation for a supporting value of the curves 22 and 23.

Furthermore, a point marked with a triangle can be seen on each of the curves 21 to 23. These points all pertain to the same air supply or fan rotational speed or power 19. In contrast to the support points, that point marked with a triangle corresponds to a calculated value. It can have been obtained, for example, by interpolation in each case between the support points of each curve. A drift test can be carried out with the values obtained in this way and the test result can be evaluated or translated to the adjacent support points.

Intervals are formed for the decision as to whether a drift test is carried out owing to a current air supply or a current fan rotational speed or a current power. The intervals are formed on the basis of the first air supply values or fan rotational speed values or power values of a drift test support point. The region of the air supply or the fan rotational speed or the power between the first air supply or fan rotational speed or power of the highest and of the lowest drift test support points can be divided into intervals. In some embodiments, the entire region of the air supply or the fan rotational speed or the power between the first air supply or fan rotational speed or power of the highest and of the lowest drift test support points is divided into intervals.

The intervals may be selected on the basis of the first air supply values or fan rotational speed values or power values of the drift test support points. A first drift test support point $P_n$ is situated close to the current air supply or close to the current fan rotational speed or close to the current power. A second drift test support point $P_{n+1}$ is more remote from the current air supply or the current fan rotational speed or the current power than the first drift test support point $P_n$. Preferably, the second drift test support point $P_{n+1}$ is adjacent to the first drift test support point $P_n$.

There are a plurality of regions, therefore. A first region is close to the first drift test support point $P_n$. A further region is located between the drift test support points $P_n$ and $P_{n+1}$ but does not include the drift test support points $P_n$ and $P_{n+1}$. Yet another region is located close to the second drift test support point $P_{n+1}$. In some embodiments, these regions do not overlap.

In some embodiments, each region comprises a third of the interval between the drift test support points $P_n$ and $P_{n+1}$. In some embodiments, the region close to $P_n$ comprises a quarter of the interval between the drift test support points $P_n$ and $P_{n+1}$. The region close to $P_{n+1}$ likewise comprises a quarter of the interval between the drift test support points $P_n$ and $P_{n+1}$. The region between the drift test support points $P_n$ and $P_{n+1}$ comprises half of the interval between the drift test support points $P_n$ and $P_{n+1}$.

If a drift test is carried out with an air supply or fan rotational speed or power close to $P_n$, the new test result is translated from this drift test to $P_n$. This conversion takes place analogously to the calculation for neighboring points disclosed in EP3045816B1. In particular, a new ionization current can be translated from this drift test to $P_n$. In some embodiments, the time interval until a new drift test for $P_n$ is carried out is re-started following the conversion to $P_n$. If a drift test is started in central region between the drift test support points $P_n$ and $P_{n+1}$, the new test result is translated from this drift test to $P_n$ and to $P_{n+1}$. In particular, a new ionization current can be translated from this drift test to $P_n$ and $P_{n+1}$. In some embodiments, a weighting or filter value is used in the allocation of the translated test result with the previous filtered drift test values in each case at the drift test support points $P_n$ and $P_{n+1}$. Following the conversion of the new test result to $P_n$ and to $P_{n+1}$ the time interval or time intervals until a new drift test is carried out can be re-started. If, finally, a drift test is carried out with an air supply or fan rotational speed or power close to $P_{n+1}$, the new test result is translated from this drift test to $P_{n+1}$. In particular, a new ionization current can be translated from this drift test to $P_{n+1}$. In some embodiments, the time interval until a new drift test is carried out for $P_{n+1}$ is re-started following the conversion to $P_{n+1}$.

A drift test is carried out if the time interval of a drift test support point $P_n$ has expired and the current air supply or fan rotational speed or power is either in the region close to the drift test support point or between drift test support point $P_n$ and $P_{n+1}$. If yet another time interval should run at the second drift test support point $P_{n+1}$ until a drift test is carried out, that time interval can be left. In some embodiments, a conversion to the second drift test support point $P_{n+1}$ can be omitted as long as the corresponding time interval has not yet expired. There is a wait for the end of the time interval for the second drift test support point $P_{n+1}$, therefore. After that time interval has expired a drift test is carried out at or in the vicinity of the second drift test support point $P_{n+1}$.

Everything stated above in relation to the point or the region relating to $P_{n+1}$, is applied equivalently also to the point or the region relating to $P_{n-1}$.

The test conditions for the drift test are defined on the basis of two curves. Firstly, the reference values, in particular the reference ionization currents, have to be defined. The reference values, in particular in the case of the reference ionization currents, can be test results and/or reference values on a reference device and/or sample device ascertained in the laboratory. In particular, the reference values can be ionization currents in the case of drift test implementations. The reference values, in particular the reference ionization currents, can be stored, for example, as support points or on the basis of curve parameters. Curve 22 in FIG. 2 shows such support points for reference values. The curve parameters can comprise, for example, curve parameters of the third, fourth, fifth or even higher order. In particular, the curve parameters can comprise parameters of polynomials of the third, fourth, fifth or even higher order.

Secondly, the change in the air number A during a drift test, for example due to values of the air supply or fan rotational speed or power during the drift test relative to each other, has to be determined. For this, on the one hand a curve of the first air supply or first fan rotational speed or first power over the second air supply or second fan rotational speed or second power can be used. Such a curve is the curve 23 in FIG. 2 in the variants: support points and interpolation for the intermediate values. On the other hand, a curve of the ratio of the first air supply or first fan rotational speed or first power to the second air supply or second fan rotational speed or second power can be used. In the simplest case, a constant is sufficient for the ratio of the first air supply or first fan rotational speed or first power to the second air supply or second fan rotational speed or second power.

Accordingly, a straight line is obtained as curve 23 as the curve of the first air supply or first fan rotational speed or first power over the second air supply or second fan rotational speed or second power. Meanwhile curves of a higher order can also be used. It is possible that the values of the air supply or fan rotational speed or power during the drift test relative to each other are not defined via support points and interpolation for the intermediate values, but via a curve by means of polynomial coefficients. In this case, air supplies or fan rotational speeds or powers should still be defined, to which the measured drift of the combustion sensor 9 is translated. In particular, air supplies or fan rotational speeds or powers should be defined to which the measured drift of the ionization electrode 9 is translated.

As a minimum implementation, the highest and lowest values in each case of the air supply or fan rotational speed or power have to be defined, and these define limits within which one or more drift test(s) can be carried out. In particular, it is provided that such values are defined in a memory of an open-loop and/or closed-loop control facility 18. Those values, together with potentially further defined values of the air supply or fan rotational speed or power, serve as values to which the measured drift of the combustion sensors 9 is translated. They are used as drift test support points in the same way as described above.

The case can occur where conditions for the drift test are defined via curve parameters. In particular, conditions for the drift test can be defined via values stored in the memory of an open-loop and/or closed-loop control facility 18. At the same time, few drift test support points $P_n$ exist. It is also possible for the same number of drift test support points $P_n$ to exist as shown in curve 22 or 23. Furthermore, it is also possible for a few more drift test support points $P_n$ to exist.

In such a case the distance of the current air supply or fan rotational speed or power from the drift test support point $P_n$, $P_{n+1}$ can be used as a parameter. The closer the current air supply or fan rotational speed or power is to the drift test support point $P_n$, $P_{n+1}$, the higher the weighting is. With that weighting the translated, new test result flows into the filtered drift test value at the support point $P_n$, $P_{n+1}$. In particular, the weighting of the translated, new test result is all the higher, the closer the current air supply or fan rotational speed or power is to the drift test support point $P_n$, $P_{n+1}$. Furthermore, the duration until the next drift test is due is set to be all the longer, the closer the current air supply or fan rotational speed or power is to the drift test support point $P_n$, $P_{n+1}$.

For example, a new test result is ascertained at a current air supply or fan rotational speed or power 24 and translated to the drift test support points $P_n$, $P_{n+1}$. The current air supply or fan rotational speed or power 24 has a distance of two fifths of the interval from $P_n$ to $P_{n+1}$ from the first drift test support point $P_n$. The current air supply or fan rotational speed or power 24 has a distance of three fifths of the interval from $P_n$ to $P_{n+1}$ from the second drift test support point $P_{n+1}$. In some embodiments, the second drift test support point $P_{n+1}$ is adjacent to the first drift test support point $P_n$. The new test result translated to the drift test support point $P_n$ is accordingly filtered to the previous filtered drift test value assigned to this drift test support point. However, filtering takes place with a weighting of only three fifths compared to a test result, which would have been ascertained exactly at the drift test support point $P_n$. In particular, a translated new test result can be filtered to the previous filtered drift test value assigned to this drift test support point. Filtering takes place with a weighting of only three fifths compared to a test result, which would have been ascertained exactly at the drift test support point $P_n$, however.

Accordingly, the new test result translated to the second drift test support point $P_{n+1}$ is filtered to the previous filtered drift test value assigned to this drift test support point. Filtering takes place with a weighting of only two fifths compared to a test result, which would have been ascertained exactly at the drift test support point $P_{n+1}$, however. In particular, a translated, new test result can be filtered to the previous drift test value assigned to this drift test support point. Filtering takes place with a weighting of only two fifths compared to a test result, which would have been ascertained exactly at the drift test support point $P_{n+1}$, however.

In some embodiments, the weighting is not necessarily varied between zero and one hundred percent over the relative position of the current air supply or fan rotational speed or power in the interval $P_n$ to $P_{n+1}$. Instead, a filter value 27 is defined for at least one drift test support point $P_n$, $P_{n+1}$. In particular, in each case one filter value can be defined for each drift test support point $P_n$, $P_{n+1}$. For example, a filter value of forty percent can be defined for a drift test support point. In particular, a filter value of forty percent can be defined in the memory of an open-loop and/or closed-loop control facility 18 for a drift test support point. This filter value corresponds to the weighting factor with which a translated test result is filtered based on a test exactly at the point $P_n$ to the previous filtered drift test value assigned to the drift test support point $P_{n+1}$. A relative distance of three fifths of the current air supply or fan rotational speed or power from the drift test support point $P_{n+1}$ results therefore in the weighting:

$$(1-3/5)\times(100\text{ percent}-40\text{ percent})+40\text{ percent}=64\text{ percent}.$$

Parts of an open-loop and/or closed-loop control facility 18 can be implemented as a hardware and/or as a software module, which is run by a computing unit optionally including container virtualization, and/or on the basis of a Cloud computer and/or on the basis of a combination of said possibilities. The software may comprise firmware and/or a hardware driver, which is run inside an operating system, and/or a container virtualization and/or an application program.

The present disclosure also describes computer program products including the features of this disclosure or carrying out the required steps. With an implementation as software, the described functions can be stored on a computer-readable medium as one or more command(s). Some examples of computer-readable media include main memory (RAM) and/or magnetic main memory (MRAM) and/or read-only memory (ROM) and/or flash memory and/or electrically programable ROM (EPROM) and/or electrically erasable programable ROM (EEPROM) and/or registers of a computing unit and/or a hard-disk drive and/or an exchangeable memory unit and/or an optical memory and/or any suitable medium which can be accessed by a computer or by other IT apparatuses and applications.

In other words, the teachings of the present disclosure include a facility (18) for open-loop and/or closed-loop control of a combustion apparatus (1), the combustion apparatus (1) comprising at least one combustion chamber (2), at least one actuator (4), which acts on an air supply for at least one combustion chamber (2), and at least one combustion sensor (9), which is arranged such that during operation of the combustion apparatus (1) it is located in the region of a flame of the at least one combustion chamber (2), wherein the open-loop and/or closed-loop control facility (18) comprises a memory with at least one list of support points, wherein a first air supply value of the combustion apparatus (1) is assigned to each support point from the at least one list of support points and wherein a drift test value and an index for ascertainment of a test result are assigned to each support point from the at least one list of support points, wherein the open-loop and/or closed-loop control facility (18) is configured to: generate a specified air supply for at least one combustion chamber (2) of the combustion apparatus (1) on the basis of the at least one actuator (4); after generating the specified air supply, select a support point from the at least one list of support points as a function of the specified air supply and on the basis of the first air supply values; decide on the ascertainment of a test result on the basis of the index relating to the selected support point; in the case of a decision in favor of the ascertainment of a test result: receive one or more signal(s) on the basis of the at least one combustion sensor (9); determine a new test result from the one signal or from the plurality of signals of the at least one combustion sensor (9); ascertain a changed drift test value for the selected support point as a function of the new test result; and store the changed drift test value in the memory of the open-loop and/or closed-loop control facility (18) as the drift test value assigned to the selected support point.

In some embodiments, the at least one list of support points is at least one list of drift test support points. In this case, each drift test support point corresponds to a first air supply over a second air supply of the combustion apparatus (1). Furthermore, a drift test value and an index for ascertainment of the drift test result are assigned to each drift test support point. In one embodiment, a reference value is assigned to each drift test support point.

In some embodiments, the first air supply of a drift test support point of the combustion facility (1) is an air supply at which a drift test is begun and the second air supply is an air supply at which a drift test is ended. The drift test serves for ascertainment of an ageing-induced drift of signals of the combustion sensor (9). In particular, the drift test serves for ascertainment of an ageing-induced drift of signals of an ionization electrode.

In some embodiments, a previous test result and an index for ascertainment of a test result are assigned to each drift test support point. This means that the respective drift test value comprises a respective, previous test result. In particular, the respective drift test value can be a respective, previous test result. In a further embodiment, the respective drift test value can be an averaging or filtering over a plurality of or all previous test results, which were ascertained for or translated to this drift test support point.

In some embodiments, the new test result comprises a new drift test result. In some embodiments, the new test result is a new drift test result.

In some embodiments, the open-loop and/or closed-loop control facility (18) can be designed to generate a specified air supply value for at least one combustion chamber (2) of the combustion apparatus (1) on the basis of the at least one actuator (4).

In some embodiments, the open-loop and/or closed-loop control facility (18) is communicatively connected to the at least one actuator (4). It can also be provided that the open-loop and/or closed-loop control facility (18) is communicatively connected to the at least one combustion sensor (9).

In some embodiments, the open-loop and/or closed-loop control facility (18) is configured to: set a specified air supply for at least one combustion chamber (2) of the combustion apparatus (1) on the basis of the at least one actuator (4).

In some embodiments, the open-loop and/or closed-loop control facility (18) is configured to: control the at least one actuator (4) for a specified air supply for at least one combustion chamber (2) of the combustion apparatus (1).

In some embodiments, the open-loop and/or closed-loop control facility (18) is configured to: regulate a specified air supply for at least one combustion chamber (2) of the combustion apparatus (1) on the basis of the at least one actuator (4).

In some embodiments, the at least one combustion sensor (9) comprises at least one ionization electrode (9).

In some embodiments, one of said facilities (18) is configured to: in the case of a decision in favor of the ascertainment of a test result: receive one or more ionization current signal(s) on the basis of the at least one ionization electrode (9); and determine a new test result from the one ionization current signal or from the plurality of ionization current signals.

In some embodiments, the open-loop and/or closed-loop control facility (18) is communicatively connected to the at least one ionization electrode (9).

In some embodiments, the at least one combustion sensor (9) is at least one ionization electrode (9). According to this specific embodiment, one of said facilities (18) is configured to: in the case of a decision in favor of the ascertainment of a test result: receive one or more ionization current signal(s) on the basis of the at least one ionization electrode (9); and determine a new test result from the one ionization current signal or from the plurality of ionization current signals.

In some embodiments, the open-loop and/or closed-loop control facility (18) is communicatively connected to the at least one ionization electrode (9).

The following possibilities result inter alia for a possible selection of starting conditions and/or reference conditions for said drift tests:

In some embodiments, there is at least one of said facilities (18), wherein the open-loop and/or closed-loop control facility (18) is configured to: select at least two support points from the at least one list; determine an air supply between the at least two selected support points by interpolation, for example by linear interpolation; and generate the determined air supply for at least one combustion chamber (2) of the combustion apparatus (1) on the basis of the at least one actuator (4).

In some embodiments, a reference value for the drift test can be determined by interpolation, for example by linear interpolation, from the reference values, which are assigned to the selected support points. Preferably, the ascertained test result is evaluated against this reference value.

In some embodiments, there is at least one of said facilities (18), wherein the open-loop and/or closed-loop control facility (18) is configured to: select at least two support points from the at least one list; calculate an air supply between the at least two selected support points by interpolation, for example by linear interpolation; and generate the calculated air supply for at least one combustion chamber (2) of the combustion apparatus (1) on the basis of the at least one actuator (4).

In some embodiments, a reference value for the drift test can be determined by interpolation, for example by linear interpolation, from the reference values, which are assigned to the selected support points. In particular, a reference value for the drift test can be calculated by interpolation, for example by linear interpolation, from the reference values, which are assigned to the selected support points. In some embodiments, the ascertained test result is evaluated against this reference value.

In some embodiments, there is at least one of said facilities (18), wherein the open-loop and/or closed-loop control facility (18) is configured to: select at least two support points from the at least one list; determine an air supply between the at least two selected support points by interpolation, for example by linear interpolation; and set the determined air supply for the at least one combustion chamber (2) of the combustion apparatus (1) on the basis of the at least one actuator (4).

In some embodiments, a reference value for the drift test can be determined by interpolation, for example by linear interpolation, from the reference values, which are assigned to the selected support points. In some embodiments, the ascertained test result is evaluated against this reference value.

In some embodiments, there is at least one of said facilities (18), wherein the open-loop and/or closed-loop control facility (18) is configured to: select at least two support points from the at least one list; calculate an air supply between the at least two selected support points by interpolation, for example by linear interpolation; and set the calculated air supply for the at least one combustion chamber (2) of the combustion apparatus (1) on the basis of the at least one actuator (4).

In some embodiments, a reference value for the drift test can be determined by interpolation, for example by linear interpolation, from the reference values, which are assigned to the selected support points. In particular, a reference value for the drift test can be calculated by interpolation, for example by linear interpolation, from the reference values, which are assigned to the selected support points. In some embodiments, the ascertained test result is evaluated against this reference value.

In some embodiments, there is at least one of said facilities (18), wherein a power of the combustion apparatus (1) stored in the memory is assigned to each support point from the at least one list of support points, wherein the open-loop and/or closed-loop control facility (18) is configured to: ascertain a power of the combustion apparatus (1) from the specified air supply; and after generating the specified air supply, select a support point from the at least one list of support points as a function of the ascertained power.

In some embodiments, there is at least one of said facilities (18), wherein a power of the combustion apparatus (1) stored in the memory is assigned to each support point from the at least one list of support points, wherein the open-loop and/or closed-loop control facility (18) is configured to: ascertain a power of the combustion apparatus (1) from the specified air supply; and after generating the specified air supply, select the support point from the at least one list of support points as a function of the ascertained power.

In some embodiments, there is at least one of said facilities (18), wherein a power stored in the memory is assigned to each air supply for a support point from the at least one list of support points, wherein the open-loop and/or closed-loop control facility (18) is configured to: ascertain a power of the combustion apparatus (1) from the specified air supply; and after generating the specified air supply, select a support point from the at least one list of support points as a function of the ascertained power.

In some embodiments, there is at least one of said facilities (18), wherein a fan rotational speed of the at least one actuator (4) stored in the memory is assigned to each support point from the at least one list of support points, wherein the open-loop and/or closed-loop control facility (18) is configured to: ascertain a fan rotational speed of the at least one actuator (4) from the specified air supply; and after generating the specified air supply, select a support point from the at least one list of support points as a function of the ascertained fan rotational speed.

In some embodiments, a fan rotational speed of the at least one actuator (4) stored in the memory is assigned to each air supply of a support point from the at least one list of support points, wherein the open-loop and/or closed-loop control facility (18) is configured to: ascertain a fan rotational speed of the at least one actuator (4) from the specified air supply; and after generating the specified air supply, select a support point from the at least one list of support points as a function of the ascertained fan rotational speed.

In some embodiments, the at least one actuator (4) comprises at least one fan (4). In some embodiments, the at least one actuator (4) is at least one fan (4).

In some embodiments, after generating the specified air supply, the open-loop and/or closed-loop control facility (18) is configured to: form in each case differences between the specified air supply and the first air supply values; select the difference whose value is the lowest; and select from the at least one list of support points the support point, which pertains to the difference with the lowest value.

In some embodiments, after generating the specified air supply, the open-loop and/or closed-loop control facility (18) is configured to: form in each case differences between the specified air supply and the first air supply values; select the difference whose value is the lowest; and select from the at least one list of support points the support point, which pertains to the difference with the lowest value.

In some embodiments, the at least one list of support points is at least one list of drift test support points. Each drift test support point corresponds to a first air supply over a second air supply of the combustion apparatus (1). In particular, the first air supply of a drift test support point of the combustion facility (1) is an air supply at which a drift test is begun and the second air supply is an air supply at which a drift test is ended. The drift test serves for ascertainment of an ageing-induced drift of signals of the combustion sensor (9). In particular, the drift test serves for ascertainment of an ageing-induced drift of signals of an ionization electrode.

In some embodiments, the open-loop and/or closed-loop control facility (18) is configured by inclusion of a difference: calculate in each case values of the differences for the formed differences.

In some embodiments, the open-loop and/or closed-loop control facility (18) is configured by inclusion of a difference: calculate in each case differences between the specified air supply and the first air supply values.

In some embodiments, the open-loop and/or closed-loop control facility (18) can be designed by inclusion of a difference: calculate in each case values of the differences for the calculated differences.

In some embodiments, a first power of the combustion apparatus (1) stored in the memory is assigned to each support point from the at least one list of support points, wherein after generating the specified air supply, the open-loop and/or closed-loop control facility (18) is configured to: ascertain a power of the combustion apparatus (1) from the specified air supply; form in each case differences between the ascertained power and the first powers, which are assigned to the support points from the at least one list of support points; assign the difference formed in each case to each support point from the at least one list of support points; select the difference whose value is the lowest; and select from the at least one list of support points the support point, which pertains to the difference with the lowest value.

In some embodiments, the open-loop and/or closed-loop control facility (18) is configured to: calculate a power of the combustion apparatus (1) from the specified air supply; and calculate in each case differences between the calculated power and the first powers, which are assigned to the support points from the at least one list of support points.

In some embodiments, a first fan rotational speed of the at least one actuator (4) stored in the memory is assigned to each support point from the at least one list of support points, wherein after generating the specified air supply, the open-loop and/or closed-loop control facility (18) is configured to: ascertain a fan rotational speed of the at least one actuator (4) from the specified air supply; form in each case differences between the ascertained fan rotational speed and the first fan rotational speeds, which are assigned to the support points from the at least one list of support points; assign the difference formed in each case to each support point from the at least one list of support points; select the difference whose value is the lowest; and select from the at least one list of support points the support point, which pertains to the difference with the lowest value.

In some embodiments, the open-loop and/or closed-loop control facility (18) is configured to: calculate a fan rotational speed of the at least one actuator (4) from the specified air supply; and calculate in each case differences between the calculated fan rotational speed and the first fan rotational speeds, which are assigned to the support points from the at least one list of support points.

In some embodiments, a number of operating hours of the combustion apparatus (1) until the next start of ascertainment of a test result is assigned to each support point from the at least one list of support points as an index for ascertainment of the test result and is stored in the memory, wherein the open-loop and/or closed-loop control facility (18) is configured to: ascertain a current number of operating hours; compare the number of operating hours until the next start of the ascertainment of the test result for the selected support point with the current number of operating hours; if the current number of operating hours is greater than or equal to the number of operating hours until the next start of the ascertainment of the test result for the selected support point: receive the one signal or the plurality of signals on the basis of the at least one combustion sensor (9); and determine a new test result from the one signal or from the plurality of signals of the at least one combustion sensor (9).

In some embodiments, the at least one combustion sensor (9) comprises at least one ionization electrode, wherein the open-loop and/or closed-loop control facility (18) is configured to: if the current number of operating hours is greater than or equal to the number of operating hours until the next start of the ascertainment of the test result for the selected support point: receive on the basis of the at least one ionization electrode (9) one or a plurality of ionization current signal(s); and determine a new test result from the one ionization current signal or from the plurality of ionization current signals.

In some embodiments, the open-loop and/or closed-loop control facility (18) is communicatively connected to the at least one ionization electrode (9).

In some embodiments, the at least one combustion sensor (9) is at least one ionization electrode, wherein the open-loop and/or closed-loop control facility (18) is configured to: if the current number of operating hours is greater than or equal to the number of operating hours until the next start of the ascertainment of the test result for the selected support point: receive one or a plurality of ionization current signals on the basis of the at least one ionization electrode (9); and determine a new test result from the one ionization current signal or from the plurality of ionization current signals.

In some embodiments, the open-loop and/or closed-loop control facility (18) is communicatively connected to the at least one ionization electrode (9).

In some embodiments, the facility (18) comprises an operating hours meter, wherein the open-loop and/or closed-loop control facility (18) is configured to: ascertain a current number of operating hours on the basis of the operating hours meter.

In some embodiments, the facility (18) is communicatively connected to an operating hours meter, wherein the open-loop and/or closed-loop control facility (18) is configured to: receive an operating hours signal from the operating hours meter; and ascertain a current number of operating hours from the operating hours signal.

In some embodiments, the operating hours meter comprises a clock based on complementary metal-oxide semiconductors. In some embodiments, the operating hours meter is a clock based on complementary metal-oxide semiconductors. Furthermore, the operating hours meter can be integrated in programing of the facility (18).

In some embodiments, the open-loop and/or closed-loop control facility (18) is configured to: ascertain the changed drift test value for the selected support point as a function of the new test result and as a function of the drift test value assigned to the selected support point.

In some embodiments, the open-loop and/or closed-loop control facility (18) is configured to: translate the new test result to the selected support point; and ascertain the changed drift test value for the selected support point by weighting the test result translated to the selected support point and by weighting the drift test value assigned to the selected support point.

In some embodiments, the open-loop and/or closed-loop control facility (18) is configured to: translate the new test result to the selected support point; and ascertain the changed drift test value for the selected support point by weighting the test result translated to the selected support point according to a first percentage and by weighting the drift test value assigned to the selected support point according to a second percentage. In some embodiments, the first percentage and the second percentage add up to one hundred percent.

In some embodiments, the open-loop and/or closed-loop control facility (18) is configured to: ascertain as a function of the new test result a first, changed drift test value for the selected support point and a second, changed drift test value for a further support point from the at least one list of support points; store the first, changed drift test value in the memory of the open-loop and/or closed-loop control facility (18) as the drift test value assigned to the selected support point; and store the second, changed drift test value in the memory of the open-loop and/or closed-loop control facility (18) as the drift test value assigned to the further support point.

In some embodiments, the open-loop and/or closed-loop control facility (18) is configured to: calculate an additional test result for the respective support point for each support point from the at least one list of support points, which is different from the selected support point, each as a function of the new test result; and store at least one calculated additional test result in the memory of the open-loop and/or closed-loop control facility (18) as the test result assigned to the respective support point.

In some embodiments, the open-loop and/or closed-loop control facility (18) is configured to: ascertain an additional drift test value for the respective support point for each support point from the at least one list of support points, which is different from the selected support point, each as a function of the new test result and as a function of the drift test value assigned to the respective support point; and store at least one ascertained additional drift test value in the memory of the open-loop and/or closed-loop control facility (18) as the drift test value assigned to the respective support point.

In some embodiments, the open-loop and/or closed-loop control facility (18) is configured to: calculate an additional test result for the respective support point for each support point from the at least one list of support points, which is different from the selected support point, each as a function of the new test result; and store each calculated additional test result in the memory of the open-loop and/or closed-loop control facility (18) as the test result assigned to the respective support point.

In some embodiments, the open-loop and/or closed-loop control facility (18) is configured to: ascertain an additional drift test value for the respective support point for each support point from the at least one list of support points, which is different from selected support point, each as a function of the new test result and as a function of the drift test value assigned to the respective support point; and store each ascertained additional drift test value in the memory of the open-loop and/or closed-loop control facility (18) as the drift test value assigned to the respective support point.

In some embodiments, the open-loop and/or closed-loop control facility (18) is configured to: ascertain a first percentage as a function of the difference with the lowest value; translate the new test result to the selected support point and ascertain the changed drift test value for the selected support point by weighting the test result translated to the selected support point according to the first percentage and by weighting the drift test value assigned to the selected support point according to a second percentage.

In some embodiments, the open-loop and/or closed-loop control facility (18) is configured to: ascertain a first percentage as a function of the difference with the lowest value; ascertain a second percentage as a function of the difference with the lowest value; translate the new test result to the selected support point; and ascertain the changed drift test value for the selected support point by weighting the test result translated to the selected support point according to the first percentage and by weighting the drift test value assigned to the selected support point according to the second percentage. In some embodiments, the first percentage and the second percentage add up to one hundred percent.

In some embodiments, the open-loop and/or closed-loop control facility (18) is configured to: regulate the combustion apparatus (1) on the basis of the changed drift test value stored in the memory of the open-loop and/or closed-loop control facility (18).

In some embodiments, the open-loop and/or closed-loop control facility (18) is configured to: control the combustion apparatus (1) on the basis of the changed drift test value stored in the memory of the open-loop and/or closed-loop control facility (18).

In some embodiments, the open-loop and/or closed-loop control facility (18) is configured to: generate an air supply for at least one combustion chamber (2) of the combustion apparatus (1) on the basis of the changed drift test value stored in the memory of the open-loop and/or closed-loop control facility (18) and on the basis of the at least one actuator (4).

In some embodiments, the open-loop and/or closed-loop control facility (18) is configured to: generate a fuel supply for the at least one combustion chamber (2) of the combustion apparatus (1) on the basis of the changed drift test value stored in the memory of the open-loop and/or closed-loop control facility (18).

In some embodiments, the open-loop and/or closed-loop control facility (18) is configured to: set an air supply for the at least one combustion chamber (2) of the combustion apparatus (1) on the basis of the changed drift test value stored in the memory of the open-loop and/or closed-loop control facility (18) and on the basis of the at least one actuator (4).

In some embodiments, the open-loop and/or closed-loop control facility (18) is configured to: set a fuel supply for at least one combustion chamber (2) of the combustion apparatus (1) on the basis of the changed drift test value stored in the memory of the open-loop and/or closed-loop control facility (18).

In some embodiments, the open-loop and/or closed-loop control facility (18) is configured to: control the at least one actuator (4) on the basis of the changed drift test value stored in the memory of the open-loop and/or closed-loop control facility (18).

In some embodiments, the open-loop and/or closed-loop control facility (18) is configured to: control at least one fuel actuator (6) on the basis of the changed drift test value stored in the memory of the open-loop and/or closed-loop control facility (18).

In some embodiments, the open-loop and/or closed-loop control facility (18) is configured to: regulate the at least one actuator (4) on the basis of the changed drift test value stored in the memory of the open-loop and/or closed-loop control facility (18).

In some embodiments, the open-loop and/or closed-loop control facility (18) is configured to: regulate at least one fuel actuator (6) on the basis of the changed drift test value stored in the memory of the open-loop and/or closed-loop control facility (18).

In some embodiments, after generating the specified air supply, the open-loop and/or closed-loop control facility (18) is configured to: form in each case differences between the specified air supply and the first air supply values; select from the formed differences the negative difference whose value is the lowest; select from the formed differences the positive difference whose value is the lowest; select from the at least one list of support points a first support point, which pertains to the negative difference with the lowest value; and select from the at least one list of support points a second support point, which pertains to the positive difference with the lowest value.

In some embodiments, after generating the specified air supply, the open-loop and/or closed-loop control facility (18) is configured to: form in each case differences between the specified air supply and the first air supply values; select from the formed differences the negative difference whose value is the lowest; select from the formed differences the positive difference whose value is the lowest; select from the at least one list of support points the support point, which pertains to the negative difference with the lowest value, as the first support point; and select from the at least one list of support points a second support point, which pertains to the positive difference with the lowest value.

In some embodiments, the open-loop and/or closed-loop control facility (18) by inclusion of a difference is configured to: calculate for the formed differences in each case values of the differences.

In some embodiments, the open-loop and/or closed-loop control facility (18) by inclusion of a difference is configured to: calculate in each case differences between the specified air supply and the first air supply values.

In some embodiments, the open-loop and/or closed-loop control facility (18) by inclusion of a difference can be designed to calculate for the calculated differences in each case values of the differences.

In some embodiments, a first power of the combustion apparatus (1) stored in the memory is assigned to each support point from the at least one list of support points, wherein after generating the specified air supply, the open-loop and/or closed-loop control facility (18) is configured to: ascertain a power of the combustion apparatus (1) from the specified air supply; form in each case differences between the ascertained power and the first powers, which are assigned to the support points from the at least one list of support points; assign the difference formed in each case to each support point from the at least one list of support points; select from the at least one list of support points a first support point, which pertains to the negative difference with the lowest value; and select from the at least one list of support points a second support point, which pertains to the positive difference with the lowest value.

In some embodiments, the open-loop and/or closed-loop control facility (18) is configured to: calculate a power of the combustion apparatus (1) from the specified air supply; and calculate in each case differences between the calculated power and the first powers, which are assigned to the support points from the at least one list of support points.

In some embodiments, a first fan rotational speed of the at least one actuator (4) stored in the memory is assigned to each support point from the at least one list of support points, wherein after generating the specified air supply, the open-loop and/or closed-loop control facility (18) is configured to: ascertain a fan rotational speed of the at least one actuator (4) from the specified air supply; form in each case differences between the ascertained fan rotational speed and the first fan rotational speeds, which are assigned to the support points from the at least one list of support points; assign the difference formed in each case to each support point from the at least one list of support points; select from the at least one list of support points a first support point, which pertains to the negative difference with the lowest value; and select from the at least one list of support points a second support point, which pertains to the positive difference with the lowest value.

In some embodiments, the open-loop and/or closed-loop control facility (18) is configured to: calculate a fan rotational speed of the at least one actuator (4) from the specified air supply; and calculate in each case differences between the calculated fan rotational speed and the first fan rotational speeds, which are assigned to the support points from the at least one list of support points.

In some embodiments, the open-loop and/or closed-loop control facility (18) is configured to: ascertain a first, changed drift test value for the first support point as a function of the new test result; ascertain a second, changed drift test value for the second support point as a function of the new test result; store the first, changed drift test value in the memory of the open-loop and/or closed-loop control facility (18) as the drift test value assigned to the first support point; and store the second, changed drift test value in the memory of the open-loop and/or closed-loop control facility (18) as the drift test value assigned to the second support point.

In some embodiments, the open-loop and/or closed-loop control facility (18) is configured to: ascertain a first, changed drift test value for the first support point as a function of the new test result and as a function of the drift test value assigned to the first support point; ascertain a second, changed drift test value for the second support point as a function of the new test result and as a function of the drift test value assigned to the second support point; store the first, changed drift test value in the memory of the open-loop and/or closed-loop control facility (18) as the drift test value assigned to the first support point; and store the second, changed drift test value in the memory of the open-loop and/or closed-loop control facility (18) as the drift test value assigned to the second support point.

In some embodiments, for each support point a number of operating hours of the combustion apparatus (1) until the next start of an ascertainment of a test result is assigned as an index for an ascertainment of the test result and is stored in the memory, wherein the open-loop and/or closed-loop control facility (18) is configured to: ascertain a current number of operating hours; and compare the number of operating hours until the next start of the ascertainment of the test result for the first support point with the current number of operating hours.

In some embodiments, the open-loop and/or closed-loop control facility (18) is configured to: if the current number of operating hours is greater than or equal to the number of operating hours until the next start of the ascertainment of the test result for the first support point: ascertain a third percentage as a function of the negative difference with the lowest value; translate the new test result to the first support point; and ascertain the first, changed drift test value for the first support point by weighting the test result translated to the first support point according to the third percentage and by weighting the drift test value assigned to the first support point according to a fourth percentage. In some embodiments, the third percentage and the fourth percentage add up to one hundred percent.

In some embodiments, for each support point a number of operating hours of the combustion apparatus (1) until the next start of ascertainment of a test result is assigned as an index for an ascertainment of the test result and is stored in the memory, wherein the open-loop and/or closed-loop control facility (18) is configured to: ascertain a current number of operating hours; and compare the number of operating hours until the next start of the ascertainment of the test result for the second support point with the current number of operating hours.

In some embodiments, the open-loop and/or closed-loop control facility (18) is configured to if the current number of operating hours is greater than or equal to the number of operating hours until the next start of the ascertainment of the test result for the second support point: ascertain a fifth percentage as a function of the positive difference with the lowest value; translate the new test result to the second support point; and ascertain the second, changed drift test value for the second support point by weighting the test result translated to the second support point according to the fifth percentage and by weighting the drift test value assigned to the second support point according to a sixth percentage. In some embodiments, the fifth percentage and the sixth percentage add up to one hundred percent.

In some embodiments, the open-loop and/or closed-loop control facility (18) is configured to: if the current number of operating hours is greater than or equal to the number of operating hours until the next start of the ascertainment of the test result for the first support point and the current number of operating hours is greater than or equal to the number of operating hours until the next start of the ascertainment of the test result for the second support point: ascertain a third percentage as a function of the negative difference with the lowest value; ascertain a fifth percentage as a function of the positive difference with the lowest value; translate the new test result to the first support point; ascertain the first, changed drift test value for the first support point by weighting the test result translated to the first support point according to the third percentage and by weighting the drift test value assigned to the first support point according to a seventh percentage; translate the new test result to the second support point; and ascertain the second, changed drift test value for the second support point by weighting the test result translated to the second support point according to the fifth percentage and by weighting the drift test value assigned to the second support point according to the seventh percentage. In some embodiments, the fourth percentage is equal to the seventh percentage. In other words, the drift test for the first support point is constantly weighted.

In one embodiment, the sixth percentage is equal to the seventh percentage. In other words, the drift test value for the second support point is constantly weighted.

In some embodiments, the open-loop and/or closed-loop control facility (18) is configured to: regulate the combustion apparatus (1) on the basis of the first, changed drift test value stored in the memory of the open-loop and/or closed-loop control facility (18) and on the basis of the second, changed drift test value stored in the memory of the open-loop and/or closed-loop control facility (18).

In some embodiments, the open-loop and/or closed-loop control facility (18) is configured to: control the combustion apparatus (1) on the basis of the first, changed drift test value stored in the memory of the open-loop and/or closed-loop control facility (18) and on the basis of the second, changed drift test value stored in the memory of the open-loop and/or closed-loop control facility (18).

In some embodiments, the open-loop and/or closed-loop control facility (18) is configured to: generate an air supply for the at least one combustion chamber (2) of the combustion apparatus (1) on the basis of the first, changed drift test value stored in the memory of the open-loop and/or closed-loop control facility (18) and on the basis of the second, changed drift test value stored in the memory of the open-loop and/or closed-loop control facility (18) and on the basis of the at least one actuator (4).

In some embodiments, the open-loop and/or closed-loop control facility (18) is configured to: generate a fuel supply for the at least one combustion chamber (2) of the combustion apparatus (1) on the basis of the first, changed drift test value stored in the memory of the open-loop and/or closed-loop control facility (18) and on the basis of the second, changed drift test value stored in the memory of the open-loop and/or closed-loop control facility (18).

In some embodiments, the fuel supply for the at least one combustion chamber (2) is generated on the basis of at least one fuel actuator (6).

In some embodiments, the open-loop and/or closed-loop control facility (18) is configured to: set an air supply for the at least one combustion chamber (2) of the combustion apparatus (1) on the basis of the first, changed drift test value stored in the memory of the open-loop and/or closed-loop control facility (18) and on the basis of the second, changed drift test value stored in the memory of the open-loop and/or closed-loop control facility (18) and on the basis of the at least one actuator (4).

In some embodiments, the open-loop and/or closed-loop control facility (18) is configured to: set a fuel supply for the at least one combustion chamber (2) of the combustion apparatus (1) on the basis of the first, changed drift test value stored in the memory of the open-loop and/or closed-loop control facility (18) and on the basis of the second, changed drift test value stored in the memory of the open-loop and/or closed-loop control facility (18).

In some embodiments, the fuel supply for the at least one combustion chamber (2) is set on the basis of at least one fuel actuator (6).

In some embodiments, the open-loop and/or closed-loop control facility (18) is configured to: control the at least one actuator (4) on the basis of the first, changed drift test value stored in the memory of the open-loop and/or closed-loop control facility (18) and on the basis of the second, changed drift test value stored in the memory of the open-loop and/or closed-loop control facility (18).

In some embodiments, the open-loop and/or closed-loop control facility (18) is configured to: control at least one fuel actuator (6) on the basis of the first, changed drift test value stored in the memory of the open-loop and/or closed-loop control facility (18) and on the basis of the second, changed drift test value stored in the memory of the open-loop and/or closed-loop control facility (18).

In some embodiments, the open-loop and/or closed-loop control facility (18) is configured to: regulate the at least one actuator (4) on the basis of the first, changed drift test value stored in the memory of the open-loop and/or closed-loop control facility (18) and on the basis of the second, changed drift test value stored in the memory of the open-loop and/or closed-loop control facility (18).

In some embodiments, the open-loop and/or closed-loop control facility (18) is configured to: regulate at least one fuel actuator (6) on the basis of the first, changed drift test value stored in the memory of the open-loop and/or closed-loop control facility (18) and on the basis of the second, changed drift test value stored in the memory of the open-loop and/or closed-loop control facility (18).

The present disclosure also deals with a combustion apparatus (1) comprising one of said control and/or regulating facilities (18). In some embodiments, a combustion apparatus (1) comprises at least one combustion chamber (2), at least one actuator (4), which acts on an air supply for the at least one combustion chamber (2), and at least one combustion sensor (9), which is arranged such that during operation of the combustion apparatus (1) it is located in the region of a flame of the at least one combustion chamber (2), and one of said facilities (18), wherein the facility (18) is communicatively connected to the at least one actuator (4) and to the at least one fuel actuator (6); and wherein the facility (18) is communicatively connected to the at least one combustion sensor (9).

The present disclosure also deals with a combustion apparatus (1) comprising at least one combustion chamber (2), at least one air actuator (4), which acts on an air supply for the at least one combustion chamber (2), at least one fuel actuator (6), which acts on a fuel supply for the at least one combustion chamber (2), and at least one combustion sensor (9), which is arranged such that during operation of the combustion apparatus (1) it is located in the region of a flame of the at least one combustion chamber (2), and one of said facilities (18), wherein the facility (18) is communicatively connected to the at least one air actuator (4) and to the at least one fuel actuator (6); and wherein the facility (18) is communicatively connected to the at least one combustion sensor (9).

In some embodiments, the at least one combustion sensor (9) comprises at least one ionization electrode; and wherein the facility (18) is communicatively connected to the at least one ionization electrode (9).

In some embodiments, the at least one combustion sensor (9) is at least one ionization electrode; and wherein the facility (18) is communicatively connected to the at least one ionization electrode (9).

The aforementioned relates to individual embodiments of the disclosure. Various changes can be made to the embodiments without deviating from the underlying idea and without departing from the framework of this disclosure. The subject matter of the present disclosure is defined by its claims. A wide variety of changes can be made without departing from the scope of the following claims.

REFERENCE NUMERALS

1 combustion apparatus
2 combustion chamber
3 exhaust gases
4 (motor-driven) fan, air actuator
5 air supply
6 fuel actuator (in particular gas quantity actuator, motor-adjustable valve)
7 fuel, in particular fuel gas
8 fuel supply duct
9 combustion sensor
10 flow and/or pressure sensor with potentially necessary fixtures in the fuel supply duct
11 pressure sensor and/or mass flow sensor and/or volume flow sensor
12 signal line to specify the air supply (air flow rate) to the fan
13 (signal line to transmit the) fan rotational speed
14 signal line to specify fuel supply (fuel flow rate) to the fuel actuator
15 signal line for an ionization signal
16 signal line for the flow and/or pressure sensor
17 signal line for the pressure sensor and/or mass flow sensor and/or volume flow sensor
18 open-loop and/or closed-loop control facility (with preferably a non-volatile memory)
19 air supply or fan rotational speed or power
20 ionization current
21 characteristic curve of an ionization current over air supply or fan rotational speed or power for $\lambda_{setpoint}$
22 characteristic curve of an ionization current over air supply or fan rotational speed or power during the drift test
23 characteristic curve of a first, upper air supply or fan rotational speed or power for the second, lower air supply or fan rotational speed or power during the drift test
24 current air supply or fan rotational speed or power
25 a first support point for a drift test
26 a second support point for a drift test
27 filter value for neighboring point correction or alternatively zero percent
28 weighting

The invention claimed is:

1. A combustion apparatus comprising:

a control facility for open-loop and/or closed-loop control of the combustion apparatus;

a combustion chamber;

an actuator adjusting an air supply for the combustion chamber; and a combustion sensor arranged, during operation of the combustion apparatus, in a region of a flame of the combustion chamber;

wherein the control facility comprises a memory storing a list of support points;

a first air supply value is assigned to each support point from the list of support points;

a drift test value and an index for ascertainment of a test result are assigned to each support point from the list of support points; and the control facility is configured to: generate a specified air supply for the combustion chamber on the basis of the actuator; after generating the specified air supply, select a support point from the list of support points as a function of the specified air supply and on the basis of the first air supply values; decide on the ascertainment of a test result on the basis of the index for the selected support point; in case of a decision in favor of the ascertainment of a test result: receive a signal from the combustion sensor; determine a new test result from the signal; ascertain a changed drift test value for the selected support point as a function of the new test result; and store the changed drift test value in the memory as the drift test value assigned to the selected support point;

wherein after generating the specified air supply, the control facility is further configured to: form in each case differences between the specified air supply and the first air supply values; select from the formed differences the negative difference whose value is the lowest; select from the formed differences the positive difference whose value is the lowest; select from the at least one list of support points the support point, which pertains to the negative difference with the lowest value, as the first support point; and select from the list of support points a second support point which pertains to the positive difference with the lowest value.

2. The combustion apparatus as claimed in claim 1, wherein:

the memory stores a power of the combustion apparatus assigned to each support point from the at least one list of support points;

the control facility is further configured to: ascertain a power of the combustion apparatus from the specified air supply; and, after generating the specified air supply, select the support point from the list of support points as a function of the ascertained power.

3. The combustion apparatus as claimed in claim 1, wherein, after generating the specified air supply, the control facility is further configured to: form in each case differences between the specified air supply and the first air supply values; select the difference whose value is the lowest; and select from the list of support points the support point which pertains to the difference with the lowest value.

4. The combustion apparatus as claimed in claim 1, wherein:

the memory stores a number of operating hours of the combustion apparatus until the next start of an ascertainment of a test result assigned to each support point from the at least one list of support points as an index for the ascertainment of the test result;

the control facility is further configured to: ascertain a current number of operating hours; compare the number of operating hours until the next start of the ascertainment of the test result for the selected support point with the current number of operating hours; if the current number of operating hours is greater than or equal to the number of operating hours until the next start of the ascertainment of the test result for the selected support point: receive a signal from the combustion sensor; and determine a new test result from the signal.

5. The combustion apparatus as claimed in claim 1, wherein the open-loop and/or closed-loop control facility is configured to: ascertain the changed drift test value for the selected support point as a function of the new test result and the drift test value assigned to the selected support point.

6. The combustion apparatus as claimed in claim 1, wherein the control facility is further configured to regulate the combustion apparatus on the basis of the changed drift test value stored in the memory.

7. The combustion apparatus as claimed in claim 1, wherein the control facility is further configured to: ascertain a first, changed drift test value for the first support point as a function of the new test result; ascertain a second, changed drift test value for the second, selected support point as a function of the new test result; store the first, changed drift test value in the memory as the drift test value assigned to the first support point; and store the second, changed drift test value in the memory as the drift test value assigned to the second support point.

8. The combustion apparatus as claimed in claim 1, wherein:

the memory stores a number of operating hours of the combustion apparatus until the next start of an ascertainment of a test result assigned for each support point from the list of support points as an index for the ascertainment of the test result; and the control facility is further configured to: ascertain a current number of operating hours; and compare the number of operating hours until the next start of the ascertainment of the test result for the first support point with the current number of operating hours.

9. The combustion apparatus as claimed in claim 8, wherein the control facility is further configured to: if the current number of operating hours is greater than or equal to the number of operating hours until the next start of the ascertainment of the test result for the first support point: ascertain a first percentage as a function of the negative difference with the lowest value; translate the new test result to the first support point; and ascertain the first, changed drift test value for the first support point by weighting the test result translated to the first support point according to the first percentage and by weighting the drift test value assigned to the first support point according to a second percentage.

10. The combustion apparatus according to claim 1, wherein:

the memory stores a number of operating hours of the combustion apparatus until the next start of an ascertainment of a test result assigned for each support point from the at least one list of support points as an index for the ascertainment of the test result;

the control facility is further configured to: ascertain a current number of operating hours; and compare the number of operating hours until the next start of the ascertainment of the test result for the second support point with the current number of operating hours.

11. The combustion apparatus according to claim 10, wherein the control facility is further configured to: if the current number of operating hours is greater than or equal to the number of operating hours until the next start of the ascertainment of the test result for the second support point: ascertain a first percentage as a function of positive difference with the lowest value; translate the new test result to the second support point; and ascertain the second, changed drift test value for the second support point by weighting the test result translated to the second support point according to the first percentage and by weighting the drift test value assigned to the second support point according to a second percentage.

12. The combustion apparatus according to claim 7, wherein the control facility is configured to regulate the combustion apparatus on the basis of the first, changed drift test value stored in the memory and on the basis of the second, changed drift test value stored in the memory.

13. The combustion apparatus according to claim 1, wherein:

the control facility is communicatively connected to the actuator; and the control facility is communicatively connected to the combustion sensor.

14. A combustion apparatus comprising:

a control facility for open-loop and/or closed-loop control of the combustion apparatus;

a combustion chamber;

an actuator adjusting an air supply for the combustion chamber; and a combustion sensor arranged, during operation of the combustion apparatus, in a region of a flame of the combustion chamber;

wherein the control facility comprises a memory storing a list of support points;

a first air supply value is assigned to each support point from the list of support points;

a drift test value and an index for ascertainment of a test result are assigned to each support point from the list of support points; and the control facility is configured to: generate a specified air supply for the combustion chamber on the basis of the actuator; after generating the specified air supply, select a support point from the list of support points as a function of the specified air supply and on the basis of the first air supply values; decide on the ascertainment of a test result on the basis of the index for the selected support point; in case of a decision in favor of the ascertainment of a test result: receive a signal from the combustion sensor; determine a new test result from the signal; ascertain a changed drift test value for the selected support point as a function of the new test result; and store the changed drift test value in the memory as the drift test value assigned to the selected support point;

wherein, after generating the specified air supply, the control facility is further configured to: form in each case differences between the specified air supply and the first air supply values; select the difference whose value is the lowest; and select from the list of support points the support point which pertains to the difference with the lowest value;

wherein the control facility is further configured to: ascertain a first percentage as a function of the difference with the lowest value; and ascertain the changed drift test value for the selected support point by weighting the new test result according to the first percentage and by weighting the drift test value assigned to the selected support point according to a second percentage.

15. The combustion apparatus as claimed in claim 14, wherein the open-loop and/or closed-loop control facility is configured to: ascertain the changed drift test value for the selected support point as a function of the new test result and the drift test value assigned to the selected support point.

16. The combustion apparatus as claimed in claim 14, wherein the control facility is further configured to regulate the combustion apparatus on the basis of the changed drift test value stored in the memory.

17. The combustion apparatus according to claim 14, wherein:

the memory stores a number of operating hours of the combustion apparatus until the next start of an ascertainment of a test result assigned for each support point from the at least one list of support points as an index for the ascertainment of the test result;

the control facility is further configured to: ascertain a current number of operating hours; and compare the number of operating hours until the next start of the ascertainment of the test result for the second support point with the current number of operating hours.

18. The combustion apparatus according to claim 17, wherein the control facility is further configured to: if the current number of operating hours is greater than or equal to the number of operating hours until the next start of the ascertainment of the test result for the second support point: ascertain a first percentage as a function of positive difference with the lowest value; translate the new test result to the second support point; and ascertain the second, changed drift test value for the second support point by weighting the test result translated to the second support point according to the first percentage and by weighting the drift test value assigned to the second support point according to a second percentage.

19. The combustion apparatus according to claim 14, wherein:

the control facility is communicatively connected to the actuator; and the control facility is communicatively connected to the combustion sensor.

* * * * *